US011854351B2

(12) United States Patent
Fulk

(10) Patent No.: US 11,854,351 B2
(45) Date of Patent: Dec. 26, 2023

(54) SYSTEMS AND METHODS FOR FACILITATING WAGERING ON E-SPORTS GAMES

(71) Applicant: Noah Fulk, Carbondale, IL (US)

(72) Inventor: Noah Fulk, Carbondale, IL (US)

( * ) Notice: Subject to any disclaimer, the term of this patent is extended or adjusted under 35 U.S.C. 154(b) by 276 days.

(21) Appl. No.: 17/323,127

(22) Filed: May 18, 2021

(65) Prior Publication Data

US 2021/0358271 A1 Nov. 18, 2021

Related U.S. Application Data

(60) Provisional application No. 63/026,641, filed on May 18, 2020.

(51) Int. Cl.
*G07F 17/32* (2006.01)

(52) U.S. Cl.
CPC ..... *G07F 17/3288* (2013.01); *G07F 17/3209* (2013.01); *G07F 17/3211* (2013.01); *G07F 17/3244* (2013.01); *G07F 17/3276* (2013.01)

(58) Field of Classification Search
CPC ..... G07F 17/3209; G07F 17/3211; G07F 17/3244; G07F 17/3276; G07F 17/3288
USPC ..... 463/25
See application file for complete search history.

(56) References Cited

U.S. PATENT DOCUMENTS

2004/0082384 A1* 4/2004 Walker ..... G07F 17/3239 463/40
2010/0160012 A1* 6/2010 Amaitis ..... G07F 17/3244 463/2
2019/0244483 A1* 8/2019 Collins ..... A63F 13/352

* cited by examiner

*Primary Examiner* — James S. McClellan
(74) *Attorney, Agent, or Firm* — Stockwell & Smedley, PSC

(57) ABSTRACT

A gaming system and method which is configured to, among other things, display a user created entry relating to a wager on an e-sports contest in a wager feed through the user interface of other users, and enable any of the other users to enter into the wager by selecting the entry.

4 Claims, 4 Drawing Sheets

SYSTEMS AND METHODS FOR FACILITATING WAGERING ON E-SPORTS GAMES

BACKGROUND OF THE INVENTION

Field of the Invention

The invention generally relates to the field of gaming, and more particularly, to a software platform or mobile application for enabling peer-to-peer wagering between users relating to various gaming activities involving e-sports computer gaming, including wagering by users on e-sports games and game events in which the users themselves participate as players, and including wagering by users on e-sports games and game events in which the users do not participate as players.

In light of the interest users have on wagering on e-sports games, both as players and non-playing watchers or supporters, there was a need in the art to provide all such users with a secure, efficient and easy to use gaming system which enables all types of wagering activity.

SUMMARY OF THE INVENTION

The invention is directed to gaming systems and methods which satisfy the need in the art, among other things.

In some embodiments, the invention is directed to a gaming system, comprising: at least one processor; at least one input device; a game server; and at least one memory device that stores a plurality of instructions that, when executed by the at least one processor, cause the at least one processor to operate with the game server and the plurality of input devices to: a) store data relating to a user account for each user of a plurality of users, wherein the stored data includes a credit balance; b) receive data relating to a wager created by a first user through a user interface, wherein the wager includes wager data comprising an interactive multiplayer game, a win condition and an amount of credits; c) display a selectable entry in a wager feed through the user interface for each user of the plurality of users, wherein the selectable entry comprises a viewable display of wager data; d) responsive to a second user selecting the selectable entry, the system enabling the second user to enter into the wager with the first user wherein the system deducts or holds credits equal to the amount of credits included in the wager data from the credit balance of the second user; e) responsive to the second user entering into the wager, display an updated selectable entry in the wager feed through the user interface for each user of the plurality of users, wherein the updated selectable entry comprises a viewable display of wager data and a wager status, the wager status relating to the second user entering into the wager with the first user; f) responsive to one or more third users selecting the updated selectable entry, the system enabling the one or more third users to: (i) create a side wager through a user interface, wherein the side wager relates to the win condition of the wager or a game event in the interactive multiplayer game, the side wager being received as side wager data from the user interface comprising an amount of the side wager and a side wager win condition, the system actuating a display of a side wager selectable entry in the wager feed through the user interface for each user of the plurality of users prior to and during play of the interactive multiplayer game, wherein such users include users viewing a live streaming communication of the play of the interactive multiplayer game, the side wager selectable entry comprises a viewable display of side wager data; and (ii) enter into a created side wager responsive to the one or more third users selecting at least one of the side wager selectable entry or the updated selectable entry, wherein responsive to selecting the updated selectable entry the system: displays the side wager selectable entry on the user interface; enables the one or more third users to enter into the side wager; and deduct or hold credits equal to the amount of credits included in the side wager data from the credit balance of the one or more third users; and g) responsive to the game server operating the interactive multiplayer game, the gaming system determining the outcome of the wager and the outcome of the side wager based on the processor comparing the operation of the interactive multiplayer game with the win condition and the side wager win condition.

In some embodiments, the first user and second user are players in the interactive multiplayer game. In some embodiments, the system enables the one or more third users to enter side wagers through the user interface during the operation of the interactive multiplayer game, wherein the one or more third users includes users that are receiving a live streaming communication of the play of the interactive multiplayer game operated by the game server. In some embodiments, the interactive multiplayer game is an arena style game.

Some embodiments of the invention are directed to a gaming method comprising the steps of: a) storing data relating to a user account for each user of a plurality of users, wherein the stored data includes a credit balance; b) receiving data relating to a wager created by a first user through a user interface, wherein the wager includes wager data comprising an interactive multiplayer game, a win condition and an amount of credits; c) displaying a selectable entry in a wager feed through the user interface for each user of the plurality of users, wherein the selectable entry comprises a viewable display of wager data; d) responsive to a second user selecting the selectable entry, enabling the second user to enter into the wager with the first user wherein the system deducts or holds credits equal to the amount of credits included in the wager data from the credit balance of the second user; e) responsive to the second user entering into the wager, displaying an updated selectable entry in the wager feed through the user interface for each user of the plurality of users, wherein the updated selectable entry comprises a viewable display of wager data and a wager status, the wager status relating to the second user entering into the wager with the first user; f) responsive to one or more third users selecting the updated selectable entry, enabling the one or more third users to: (i) create a side wager through a user interface, wherein the side wager relates to the win condition of the wager, the side wager being received as side wager data from the user interface comprising an amount of the side wager and a side wager win condition, actuating a display of a side wager selectable entry in the wager feed through the user interface for each user of the plurality of users, wherein the side wager selectable entry comprises a viewable display of side wager data; and (ii) entering into a created side wager responsive to the one or more third users selecting at least one of the side wager selectable entry or the updated selectable entry, wherein responsive to selecting the updated selectable entry: displaying the side wager selectable entry on the user interface; enabling the one or more third users to enter into the side wager; and responsive thereto deducting or holding credits equal to the amount of credits included in the side wager data from the credit balance of the one or more third users; and g) responsive to the game server operating the interactive multiplayer game, determining the outcome of the wager and the outcome of the side wager based on the processor comparing the operation of the interactive multiplayer game with the win condition and the side wager win condition.

In some embodiments, the method further comprises the step of the processor transferring the any credits deducted or on hold according to the outcome of the wager and the outcome of the side wager.

Other embodiments, features and advantages of the invention will be readily appreciated and apparent from the following detailed description when considered in connection with the accompanying drawings.

DETAILED DESCRIPTION OF THE INVENTION

Figure 1:
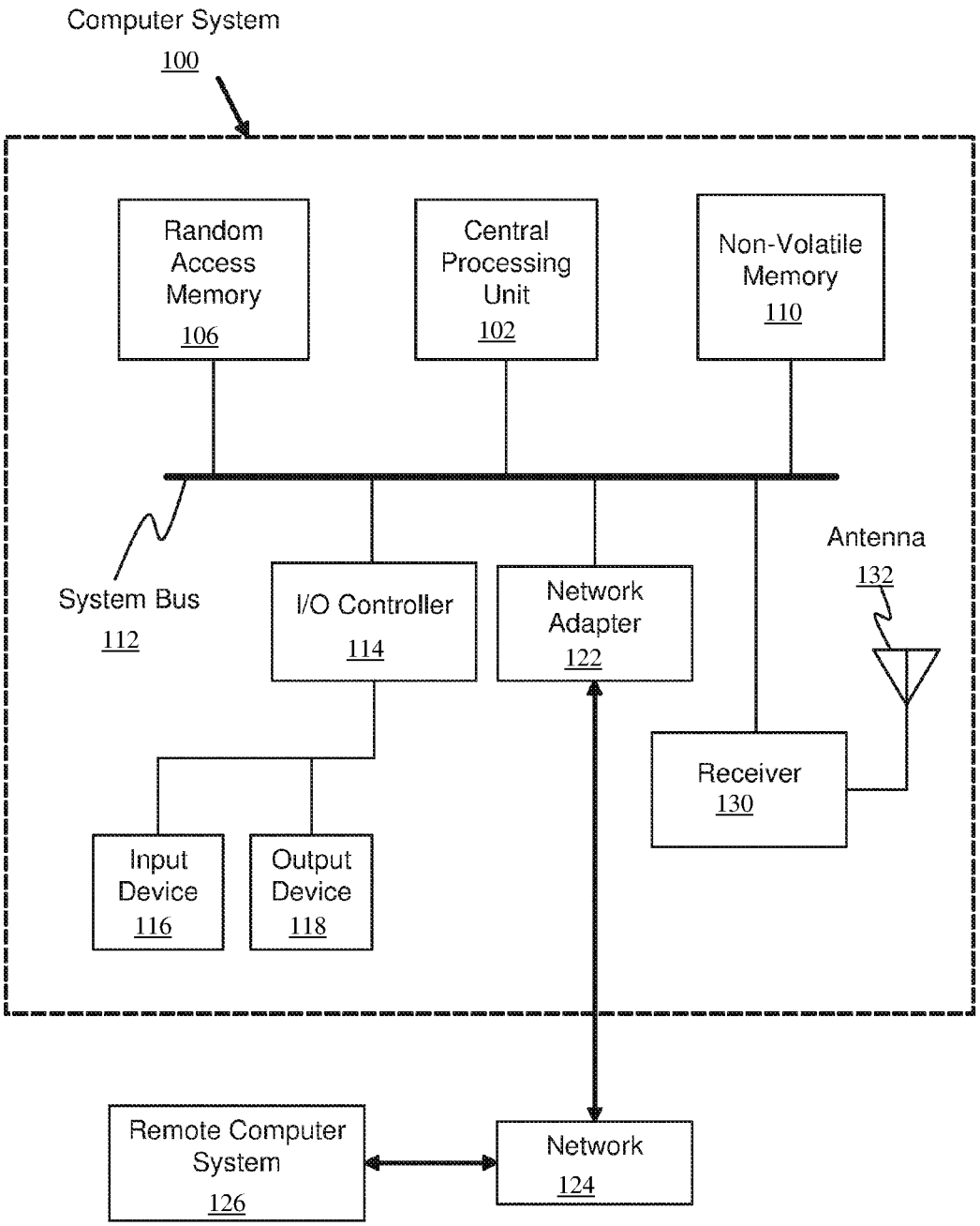
FIG. 1 is a block diagram showing an exemplary gaming system suitable for use in accordance with some embodiments of the invention.

The invention is directed to systems and methods of providing, hosting and participating gaming activity and gaming contests in which users wager against other users on a bet, that is, a proposition that an outcome will (or will not) occur. The term "user" as used herein includes anyone that accesses or "uses" the systems and methods of the invention, including but not limited to, those users who participate in games as players, and individuals who view or "stream" games being played by others. Exemplary systems and methods for enabling features according to some embodiments of the system are referred to hereinafter as a "gaming system" or "system."

In some embodiments of the invention, users register with the gaming system on a website or through a mobile application to establish an account, provided that certain requirements are met, such as requirements relating to age and geographical location. Once registered, users may then establish credit, which may comprise free credits, such as for use in play for fun scenarios, or a monetary amount received via a credit card or bank transfer. In some embodiments users use crypto-currency, such as Bitcoin, or a unique crypto-currency made available for use through an exchange associated with the system of the invention. In some embodiments, the system holds or facilitates holding any wagered amount from one or both parties in escrow, whereas in other embodiments the system of the invention initiates a transfer of funds between users pursuant to the outcome of the wager.

Features of the gaming system may be implemented in accordance or in conjunction with one or more of a variety of different types of devices, such as those described herein, including computer based platforms that are specially configured for the provision of eSports games, such as electronic player consoles or terminals, multiplayer platforms, electronic machines, and other devices that are not specially configured for the provision of eSports games, such as personal computers, tablets, mobile devices and smartphones, but which can be enabled as a platform or device through which the features of the invention can be implemented or otherwise made accessible during game play. Embodiments of the invention therefore contemplate a variety of different gaming systems each having one or more of a plurality of different features, attributes, or characteristics as disclosed herein.

It should nonetheless be understood that certain gaming systems of those discussed herein may include and be implemented with special features and/or additional circuitry that differentiates them from general-purpose computers (e.g., desktop PC's and laptops). It is contemplated that devices enabling the receipt, transfer, management and determination of currency, either by players using the system to play or to place wagers on play of the eSports games, will be included in some embodiments of a gaming system. Additionally, in certain applications of the gaming systems of the invention, its operation is or will be regulated to ensure fairness and security. In many cases, gaming systems of the invention are operable to dispense substantial monetary amounts. Therefore, to satisfy security requirements, hardware and software architectures may be implemented in gaming systems of the invention that differ significantly from those of general-purpose computers.

For example, an important difference between gaming systems of the invention and common computer systems is that a gaming system must demonstrate sufficient safeguards that prevent an operator or player of a gaming device from manipulating hardware and software in a manner that gives them an unfair or even an illegal advantage. Gaming systems of the invention may therefore have a means to determine if the code it will execute is valid, and if the code is not valid, the gaming system will have a means to prevent the code from being executed, among other protections.

Gaming systems of the invention may also have unique requirements that differ from a personal computer, such as peripheral security requirements not usually addressed by personal computers. For instance, monetary devices, such as card reading devices and ticket printers, as well as computing devices and applications that are used to govern player accounts, determine and implement transaction and service fees, credit and debit player account balances and handle the input and output of currency or cash to the gaming system have security requirements that are not typically addressed in personal computers. Therefore, many personal computer techniques and methods developed to facilitate device connectivity and device compatibility do not address the emphasis placed on security.

The foregoing notwithstanding, features of the invention may be implemented on devices as part of the gaming system of the invention which are not specially configured. In such instances, suitable measures are taken to address similar issues, including issues of security and game integrity, as well as issues relating to establishing secure player accounts and handling currency and monetary transfers despite any lack of specific hardware for addressing such issues. Accordingly, a gaming system as used herein refers to various configurations that include one or more central servers, central controllers, or remote hosts, one or more specially configured devices and/or one or more devices which are not specially configured, such as desktop computers, laptop computers, tablet computers or computing devices, televisions, personal digital assistants (PDAs), smartphones and other mobile computing devices. Together, all such devices which may be used as an element of the gaming system to provide eSports games, whether specially configured or not, are hereinafter collectively referred to as "gaming devices." Thus, in various embodiments, the gaming system of the invention includes one or more gaming devices of any kind. The gaming devices may be configured to communicate with the central server, central controller or remote host through a communication link, such as a local or wide area data network, closed, intranet or open system or remote link such as the Internet.

Gaming systems of the invention further include software for implementing features of the invention, and thus further includes code, programs and software-as-a-service (SaaS) systems, among other things. For example, the gaming system of some embodiments of the invention includes a computer program encoded in a computer-readable memory which comprises computer-executable instructions that, when executed, causes one or more computer systems to perform embodiments and provide the features of the invention described herein.

FIG. 1 is a block diagram showing an exemplary gaming system 100 suitable for storing and/or executing a computer program in accordance with embodiments of the invention. Gaming system 100 includes a central processing unit 102 having at least one microprocessor. Central processing unit 102 can be coupled directly or indirectly to memory elements through system bus 112. The memory elements comprise computer-readable memory capable of storing computer-executable instructions. The memory elements can include random access memory 106 employed during the actual execution of the program code and non-volatile memory 110 for longer term storage of data and instructions. One or more input devices 116 and output devices 118 can be coupled to system bus 112 either directly or through an intervening I/O controller 114. Examples of input device 116 include, but are not limited to, a pointing device, such as a mouse or a trackpad, or a keyboard. Examples of input device 116 can also include an electronic number generating device for generating random numbers or pseudorandom numbers to be used where randomization is needed. The number generator can comprise a hardware device connected to gaming system 100, such as a universal serial bus (USB) dongle containing a circuit that generates random numbers or pseudorandom numbers. Examples of output device 118 include, but are not limited to, a display screen or a printer. Input device 116 and output device 118 can be combined into a single device comprising a touchscreen comprising a display screen (for displaying information to the user of gaming system 100) having a touch-sensitive surface (for receiving input from the user). Network adapters 422 may also be coupled to gaming system 100 to enable the system to become coupled to remote computer system 126 or remote printers or storage devices through intervening private or public networks 124. Modems, cable modems, Ethernet cards, and wireless network adapters are just a few of the currently available types of network adapters. Gaming system 100 can include one or more receivers 130. Receiver 130 receives wireless signals via antenna 132. Receiver 130 is adapted for receiving a data signal from a transmitting device. Receiver 130 can comprise a transceiver capable of both transmitting and receiving wireless data signals. While various component devices of gaming system 100 are shown as separate devices in FIG. 1 for purposes of description, various component devices may be integrated into a single device as is known in the art, such as in a system-on-a-chip (SoC) device.

Figure 2:
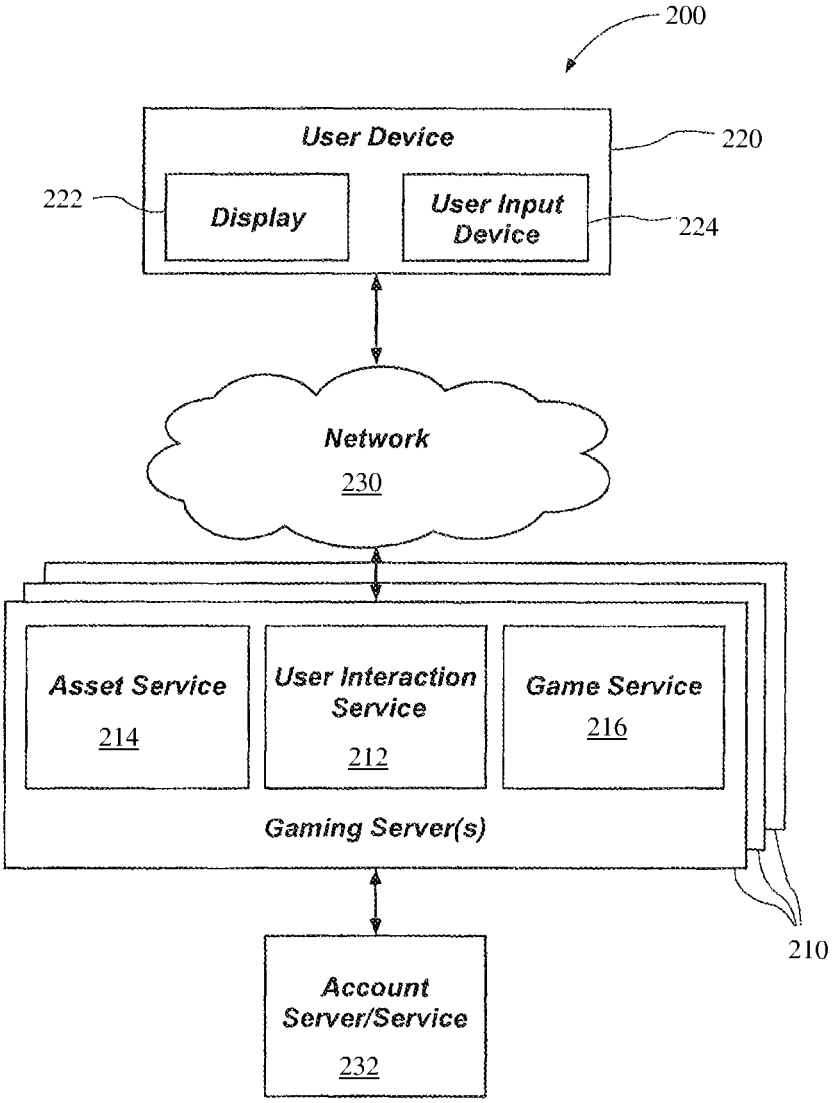
FIG. 2 is a schematic block diagram of an exemplary gaming system for implementing another embodiment of the invention.

In some embodiments, games in accordance with this disclosure may be administered using a gaming system employing a client-server architecture (e.g., over the Internet, a local area network, etc.). FIG. 2 is a schematic block diagram of an exemplary gaming system 200 for implementing games of the invention so that end users may remotely access games, stream live games and receive the wager feed, as well as create and communicate direct and side wager entries in the wager feed to other users and streamers as described herein, among other activities.

The gaming supported by the gaming system 200 may be operated with real currency or with virtual credits or other virtual (e.g., electronic) value indicia. For example, the real currency option may be used and currency cashed out at the end of a game session. The virtual credits option may be used with games of the invention in which credits may be issued to a player to be used for fees and wagering, if applicable. A player may be credited with credits in any way allowed, including, but not limited to, a player purchasing credits; being awarded credits as part of a contest, tournament or a win event in this or another game (including wagering and non-wagering games); being awarded credits as a reward for use of a product, service, or other enterprise, time played in one session, or games played; or may be as simple as being awarded virtual credits or points upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another free or fee-based game or gaming session. The same credit redemption restrictions may be applied to some or all of credits won in a fee-based game as well. Another method of issuing credits includes issuing free credits in exchange for identifying friends who may want to play. In another embodiment, additional credits may be issued after a period of time has elapsed to encourage the player to resume playing the game. The gaming system 200 may enable players to buy additional game credits to allow the player to resume play. Objects of value may be awarded to players, which may or may not be in a direct exchange for credits. For example, a prize may be awarded or won for a highest scoring player during a defined time interval or tournament. All variations of credit redemption are contemplated.

The gaming system 200 may include a gaming platform to establish a portal for an end user to access a game or tournament hosted by one or more gaming servers 210 over a network 230. In embodiments, games of the invention are accessed through a user interaction service 212. The gaming system 200 enables players to interact with a user device 220 through a user input device 224 and a display 222 and to communicate with one or more gaming servers 210 using a network 230 (e.g., the Internet). Typically the user device is remote from the gaming server 210 and the network is the word-wide web (i.e., internet).

In some embodiments, the gaming servers 210 may be configured as a single server to administer games in combination with the user device 220. In other embodiments, the gaming servers 210 may be configured as separate servers for performing separate, dedicated functions associated with administering games of the invention. Accordingly, the following description also discusses "services" with the understanding that the various services may be performed by different servers or combinations of servers in different embodiments. The gaming servers 210 may include a user interaction service 212, a game service 216, and an asset service 214. In some embodiments, one or more of the gaming servers 210 may communicate with an account server 232 performing an account service 232. As explained more fully below, for some games disclosed herein, the account service 232 may be separate and operated by a different entity than the gaming servers 210. However, in some embodiments the account service 232 may also be operated one or more of the gaming servers 210.

The user device 220 may communicate with the user interaction service 212 through the network 230. The user interaction service 212 may communicate with the game service 216 and provide game information, including tournament entry fees and availability, to the user device 220. In some embodiments, the game service 216 may also include a game engine or connection with an independent game engine. The game engine may comprise game rules, such as those relating to the games used to implement the tournament or contest. In some embodiments, a single user device 220 communicates with a game engine provided by the game service 216, while other embodiments may include a plurality of user devices 220 configured to communicate and provide end users with access to the same game provided by the game service 216, such as in a multiplayer or team tournament. In addition, a plurality of end users may be permitted to access a single user interaction service 212, or a plurality of user interaction services 212, to access the game service 216. The user interaction service 212 may enable a user to create and access a user account and interact with game service 216. The user interaction service 212 may enable users to initiate, join or wait to participate in new games, tournaments and contests, and interface with others in connection with such activities.

The user interaction service 212 may also provide a client for execution on the user device 220 for accessing the gaming servers 210. The client provided by the gaming servers 210 for execution on the user device 220 may be any of a variety of implementations depending on the user device 220 and method of communication with the gaming servers 210. In one embodiment, the user device 220 may connect to the gaming servers 210 using a web browser, and the client may execute within a browser window or frame of the web browser. In another embodiment, the client may be a stand-alone executable on the user device 220.

For example, the client may comprise a relatively small amount of script, also referred to as a "script driver," including scripting language that controls an interface of the client. The script driver may include simple function calls requesting information from the gaming servers 210. In other words, the script driver stored in the client may merely include calls to functions that are externally defined by, and executed by, the gaming servers 210. As a result, the client may be characterized as a "thin client." The client may simply send requests to the gaming servers 210 rather than performing logic itself. The client may receive player inputs, and the player inputs may be passed to the gaming servers 210 for processing and executing the wagering game. In some embodiments, this may involve providing specific graphical display information for the display 222 as well as game outcomes.

As another example, the client may comprise an executable file rather than a script. The client may do more local processing than does a script driver, such as calculating where to show what game symbols upon receiving a game outcome from the game service 216 through user interaction service 212. In some embodiments, portions of an asset service 214 may be loaded onto the client and may be used by the client in processing and updating graphical displays. Some form of data protection, such as end-to-end encryption, may be used when data is transported over the network 230. The network 230 may be any network, such as, for example, the Internet or a local area network.

The gaming servers 210 may include an asset service 214, which may host various media assets (e.g., text, audio, video, and image files) to send to the user device 220 for presenting a gaming platform, games and/or gaming applications. In other words, the assets presented to the end user may be stored separately from the user device 220. For example, the user device 220 requests the assets appropriate for the game played by the user; as another example, especially relating to thin clients, just those assets that are needed for a particular display event will be sent by the gaming servers 210, including as few as one asset. The user device 220 may call a function defined at the user interaction service 212 or asset service 214, which may determine which assets are to be delivered to the user device 220 as well as how the assets are to be presented by the user device 220 to the end user. Different assets may correspond to the various user devices 220 and their clients that may have access to the game service 216 and to different variations of wagering games.

The gaming servers 210 may include the game service 216, which may be programmed to administer wagering games and determine game play outcomes to provide to the user interaction service 212 for transmission to the user device 220. For example, the game service 216 may include rules for one or more games, contests or tournaments, such that the game service 216 controls some or all of the game flow for a selected game, contest or tournament as well as the determined outcomes. The game service 216 may include other game logic relating to wagering opportunities on the game, contest or tournament. The game service 216 may perform random number generation for determining random game elements.

The user device 220 may present a gaming interface to the player and communicate the user interaction from the user input device 224 to the gaming servers 210. The user device 220 may be any electronic system capable of displaying gaming information, receiving user input, and communicating the user input to the gaming servers 210. For example, the user device 220 may be any game device, such as a desktop computer, a laptop, a tablet computer, a set-top box, a mobile device (e.g., a smartphone), a kiosk, a terminal, or another computing device. The client may be a specialized application or may be executed within a generalized application capable of interpreting instructions from a gaming system of the invention, such as a web browser.

The client may interface with an end user through a web page or an application that runs on a device including, but not limited to, a smartphone, a tablet, or a general computer, or the client may be any other computer program configurable to access the gaming servers 210.

In some embodiments, components of the gaming system 200 may be operated by different entities. For example, the user device 220 may be operated by a third party, such as a dedicated gaming establishment for providing tournaments and contests or an individual, that links to the gaming servers 210, which may be operated, for example, by a game service provider. Therefore, in some embodiments, the user device 220 and client may be operated by a different administrator than the operator of the game service 216. In other words, the user device 220 may be part of a third-party system that does not administer or otherwise control the gaming servers 210 or game service 216. In other embodiments, the user interaction service 212 and asset service 214 may be operated by a third-party system. For example, a dedicated gaming entity may operate the user interaction service 212, user device 220, or combination thereof to provide its customers access to game content managed by a different entity that may control the game service 216, amongst other functionality. In still other embodiments, all functions may be operated by the same administrator. For example, a dedicated gaming entity may elect to perform each of these functions in-house, such as providing access to the user device 220, delivering the actual game content, and administering the gaming system 200.

The gaming servers 210 may communicate with one or more external account servers 232. The gaming servers 210 may communicate with the account service 232 to verify the existence of funds for payment of fees or wagers and instruct the account service 232 to execute debits and credits. Additional features may be supported by the gaming servers 210, such as hacking and cheating detection, data storage and archival, metrics generation, messages generation, output formatting for different end user devices, as well as other features and operations.

Figure 3:
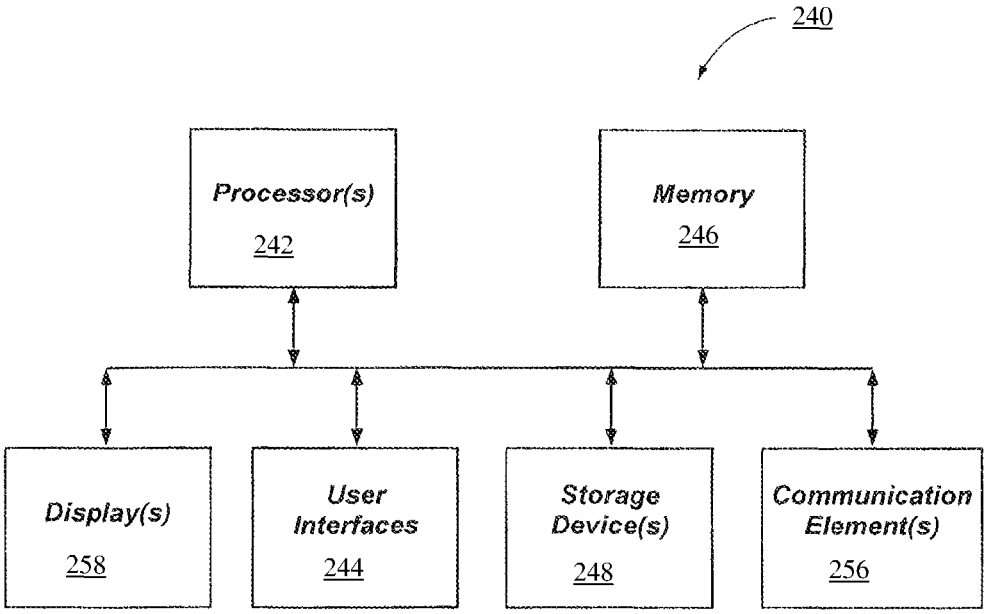
FIG. 3 is a simplified block diagram showing elements of computing or gaming devices that may be used in systems and apparatuses of the invention.

FIG. 3 is a simplified block diagram showing elements of computing or gaming devices that may be used in systems and apparatuses of this disclosure. The gaming device 240 may be a user-type computer, a file server, a computer server, a notebook computer, a tablet, a handheld device, a mobile device, or other similar computer system for executing software. Gaming device 240 may be configured to execute software programs containing computing instructions and may include one or more processors 242, memory 246, one or more displays 258, one or more user interface elements 244, such as the wager feed, wager creation and communication elements, one or more communication elements 256, and one or more storage devices 248 (also referred to herein simply as storage 248).

The processors 242 may be configured to execute a wide variety of operating systems and applications including the computing instructions for administering games, contests and tournaments of the invention.

The memory 246 may be used to hold computing instructions, data, and other information for performing a wide variety of tasks including administering games of the invention. By way of example, and not limitation, the memory 246 may include Synchronous Random Access Memory (SRAM), Dynamic RAM (DRAM), Read-Only Memory (ROM), Flash memory, and the like.

The display 258 may be a wide variety of displays such as, for example, light emitting diode displays, liquid crystal displays, cathode ray tubes, and the like. In addition, the display 258 may be configured with a touch-screen feature for accepting user input, such as a user selecting a wager from the wager feed, as a user interface element 244.

As non-limiting examples, the user interface elements 244 may include elements such as displays, keyboards, push buttons, mice, joysticks, haptic devices, microphones, speakers, cameras, and touchscreens.

As non-limiting examples, the communication elements 256 may be configured for communicating with other devices or communication networks. As non-limiting examples, the communication elements 256 may include elements for communicating on wired and wireless communication media, such as for example, serial ports, parallel ports, Ethernet connections, universal serial bus (USB) connections, IEEE 1394 ("firewire") connections, Thunderbolt™ connections, Bluetooth® wireless networks, ZigBee wireless networks, 802.11 type wireless networks, cellular telephone/data networks, and other suitable communication interfaces and protocols.

The storage 248 may be used for storing relatively large amounts of nonvolatile information for use in the gaming device 240 and may be configured as one or more storage devices. By way of example, and not limitation, these storage devices may include computer-readable media (CRM). This CRM may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

A person of ordinary skill in the art will recognize that the computing system 240 may be configured in many different ways with different types of interconnecting buses between the various elements. Moreover, the various elements may be subdivided physically, functionally, or a combination thereof. As one non-limiting example, the memory 246 may be divided into cache memory, graphics memory, and main memory. Each of these memories may communicate directly or indirectly with the one or more processors 242 on separate buses, partially-combined buses, or a common bus.

In accordance with the invention, a gaming system of the invention, such as gaming systems 100 or 200, may be used to implement and provide platforms designed to provide player experiences in exchange for transaction fees and service fees paid by the player for delivery of these experiences to them. In some embodiments, these service fees and transaction fees are applied differently by the gaming system of the invention and are independent on the experience being provided to the player.

In one embodiment, the gaming system provides for an e-sports contest, such as an arena style game mode that engages players in a skill-based competitions between each other, either individually or as part of a team. For purposes of this embodiment, such contests involve: an engagement between two players or teams of player in which there is a clear "winner" and "loser" of the contest as determined by the gaming system detecting the occurrence of a predetermined win condition, such as but not limited to, one player eliminating the other from play or performing a specific action at a requisite time, within a requisite time or order or prior to any other player.

In operation users may challenge other users to compete in an e-sports contest, while also making a wager on the outcome of the contest. The system of the invention provides platform features which allow all types of users, whether the user is playing in a game or not, to create their own wagers, receive wagers created by others and participate in such wagering activity. Wagers can be inputted by users and selected by the user to be made known and open to certain groups of users or generally all other users for one user to accept. Notifications of open and available wagers may be sent to all users or otherwise posted and made searchable.

For example, the gaming system of the invention discussed below is enabled to market, promote, facilitate and implement wagering transactions between competing users involved in a contest. This "direct" wager type can be 1v1, 2v2, 3v3, 4v4, 5v5, or 6v6 (depending on the game). Users select the game on their respective user interface provided by the system, and type of wager they wish to place. A direct wager can be made available for one user to bet against one or more other users, without constraints or with constraints such as a limit or number the total amount at stake is not to exceed. Once all the users involved have agreed to the match the wager will be displayed on the wagers feed or stream provided by the gaming system. The wager feed of this embodiment is presented in the form of a general ledger listing all current wagers on the user interface. Other users can then select this wager from the display on the user interface and enter a side wager, including streamer wagers as discussed herein, relating to the direct wager or game events through the user interface before and for the duration the game is operated and played by players, that is, other users. The system may alternately allow and restrict certain types of wagers variously during game play.

Examples of a direct wager include: User@XYZ wagers $10 against User@ABC in a 1v1 to compete for the most kills in the game Call of Duty. The game mode is Team Death Match. User@ABC accepts the wager, User@XYZ confirms. This wager is now locked into place and is located on the wager feed. The $20 total is locked until results have been reported. Other users can see this bet on the wager feed and select this match to create a side wager.

Accordingly, in the gaming system the wager and wager details such as the monetary amount, game and game parameters, may be communicated through the mobile application and the receiving party or parties may be notified through any conventional means. Once accepted, a wager is then confirmed between the users and any financial information may be requested or the transaction involved may be executed. The user that created a wager can control the users which may participate in the wager. For example, the user may restrict the wager to certain users, such as the users on a user friends' list, based on user interest, prior wagering or game history or geography.

The system of the invention can also provide for side wagering between users on a direct wager, that is, on the outcome of the wager itself, on a user in the direct wager, using the same terms, the same or different amount and directed at the same or different users, and side wagering between users specifying different terms, such as wagering on different game play events. Users can therefore wager against other users on an existing wager or create their own unique side wager.

Examples include: A direct wager is selected from the wager feed and a side wager is created. User@123 creates a Side Wager of $5 that User@XYZ will get 10 kills or more. User@123 can select to leave the Side Wager open (any user can accept the Side Wager) or closed (only a particular user can accept the Side Wager). The original wager is then displayed with the Side Wager listed underneath on the Side Wager feed. User@987 is watching User@456's stream (live feed of user playing the game) and thinks User@456 will lose the game. User@987 creates an open Side Wager of $20 that User@456 will lose that match. User@987's wager is open so any other users can accept the bet. This wager is then displayed on the Side Wager feed as "Open Side Wager." All other users will see on the Side Wager feed that User@987 has created a Side Wager of $20 betting that User@456 will lose the game. User@XYZ accepts the Side Wager against User@987 and the wager is displayed on the Side Wager Feed.

A fee may be charged by the gaming system. The fee may be subscription based fee. The fee may also be use based, such as a fixed amount upon each wagering transaction or percentage of the amount wagered. In some embodiments, one of the wagering parties pays a fee for use of the gaming system while the other does not. For example, the user initiating the wager may pay the fee. Alternatively, the losing or winning party may pay the fee. In other embodiments, the parties share any fee, equally or otherwise.

In one exemplary embodiment of the gaming system, the wagered amount and a fee is received, withdrawn and/or collected from each of the wagering parties. In other words, the system of the invention receives twice the wagered amount and twice the amount of the fee. Upon the outcome of the wager being determined, the system of the invention facilitates transferring to the winner, an amount equal to twice the wagered amount and a single fee, thus retaining a single fee as payment for the service. In other embodiments, any amounts involved are deducted from a user's credit balance stored in connection with a user account and held. In other embodiments, any amounts involved are suspended from being withdrawn or frozen in a user's credit balance stored in connection with a user account.

The game server operating the game service administers contests between users according to the game rules and administers gaming activity according to any win conditions and actions associated with accomplishment of the win condition. All play of a game involved in a contest provided by the game service is monitored and processed, such that actions are compared with preset win conditions to determine whether conditions or criteria are satisfied for receiving points or otherwise winning a contest. For example, in embodiments involving a player competing in a first person shooter game against another player, the win condition is satisfied upon a player eliminating another in the game arena according to the game rules. Game server communicates with the account server for purposes of crediting winning player accounts or debiting losing player accounts, as well as applying a service fee in the case of a third party service provider.

The gaming system is further enabled for and by all users, including participating users and users who are streaming the contest live, either through the user interface or other display device, whereby all users can select a wager from the wager feed, create and communicate a side wager, including a streamer wager, to other users through the user interface and gaming system before and during game operation and play by players.

For example: User@456 is streaming the game Call of Duty and opens a "capped" wager (as discussed below, the wager is not to exceed a specific amount) of $2,000 that he will win ⅔ games. The Game mode is Team Deathmatch at a $10 entry price (users can do multiple entrees). This allows for a maximum of 200 other users to participate in the streamer wager (If users do multiple entrees the wager is still capped at $2,000 and cannot exceed it). Once the streamer wager capacity has been met User@456 will confirm the wager and begin competing (User@456 can confirm the wager before maximum capacity is met). This wager is displayed through the user interface to live streamers on the wager feed or a streamer wagers feed. A capped wager as discussed herein is a limit on how much betting action a side wager, including streamer wagers, can potentially receive. This limits the user's potential loss and boosts engagement for streamers by competing against several viewers.

Figure 4:
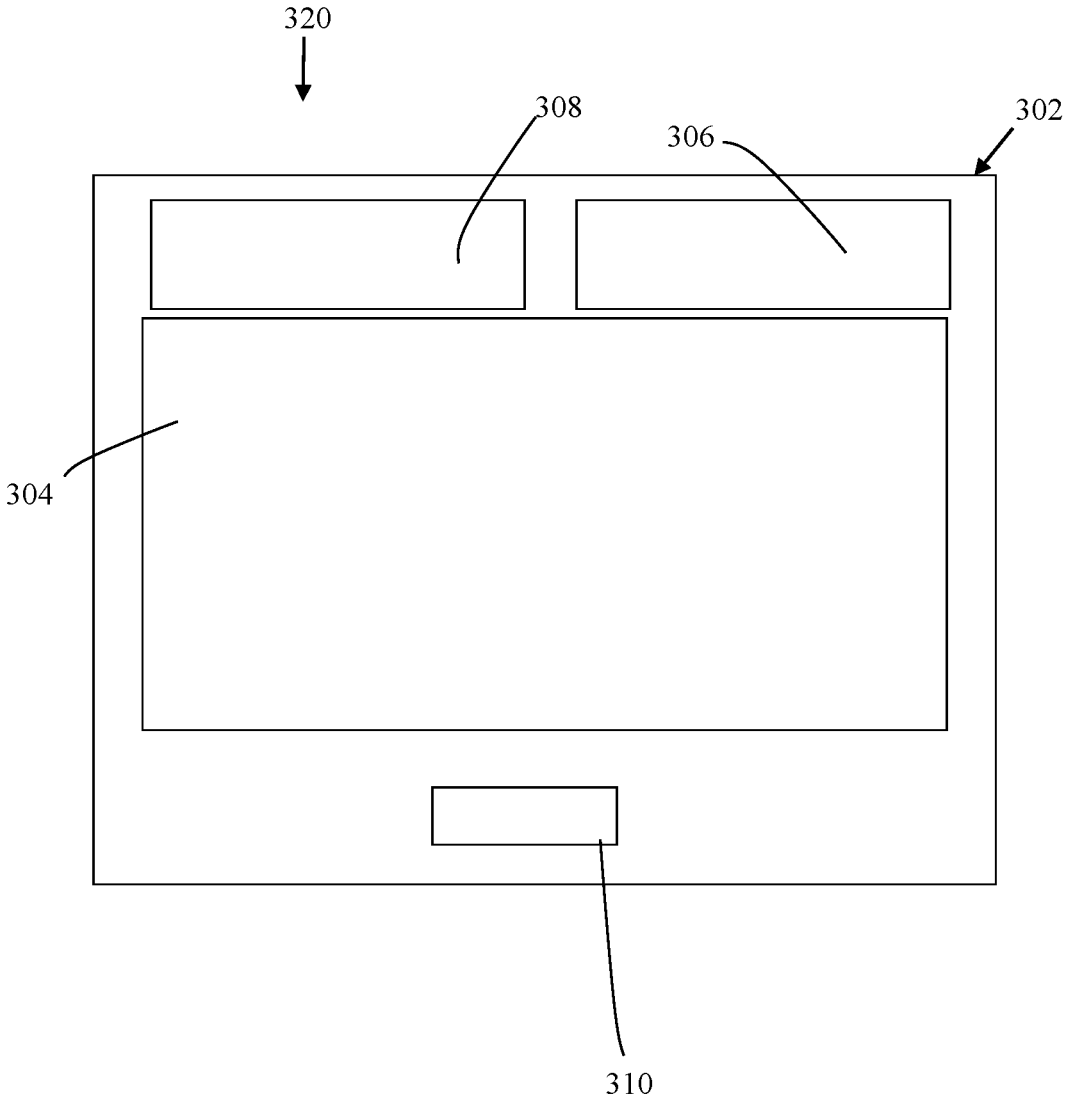
FIG. 4 provides an exemplary game screen and user interface which may be displayed to players illustrating the operation and various features of a gaming system and method constructed according to some embodiments of the invention.

FIG. 4 illustrates an exemplary user interface 302 displayed on a user device 320 and configured to display a game presentation in field 304 provided by a game server. Game presentation 304 may be an arena style game. A scrolling wager feed listing created wagers and wagers which have been created by players may be displayed in field 306. In this embodiment, side wagers, including streamer wagers are also displayed in field 306. Players may select wagers from field 306 to review and enter into available wagers as discussed herein. In this embodiment, a second wager feed is displayed in field 308 including a scrolling list of previous wagers. A button 310 may be used to create a wager (such as a direct, side or streamer wager) for communication to other users in the wager feed through user interfaces, such as user interface 302, on each other users' respective user device, such as user device 320. Alternatively, selecting a wager from the wager feed displayed in field 306 may enable access to a wager creation screen for creating and communicating a wager to other users.

Some portions of the disclosure are presented in terms of algorithms (e.g., as represented in flowcharts, prose descriptions, or both) and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality. However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," "determining," or the like, refer to the action and processes of a computer system, or similar electronic computing device (such as a specific computing machine), that manipulates and transforms data represented as physical (electronic) quantities within the computer system memories or registers or other such information storage, transmission or display devices.

Certain aspects of the embodiments include process steps and instructions described herein in the form of an algorithm. It should be noted that the process steps and instructions of the embodiments can be embodied in software, firmware, or hardware, and when embodied in software, could be downloaded to reside on and be operated from different platforms used by a variety of operating systems. The embodiments can also be in a computer program product, which can be executed on a computing system.

Some embodiments also relate to an apparatus for performing the operations herein. Such an apparatus may be specially constructed for the purposes, e.g., a specific computer, or it may comprise a general-purpose computer selectively activated or reconfigured by a computer program stored in the computer. Such a computer program may be stored in a computer-readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be a transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for the purposes of enablement and best mode.

Those skilled in the art will appreciate that the types of software and hardware used are not vital to the full implementation of the methods of the invention. The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

While exemplary systems and methods, and applications of methods of the invention, have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Additional information regarding exemplary embodiments of the invention is provided below.

Computer Program

In some embodiments, the methods, systems, and media disclosed herein include at least one computer program, or use of the same. A computer program includes a sequence of instructions, executable in the digital processing device's CPU, written to perform a specified task. Computer readable instructions may be implemented as program modules, such as functions, objects, Application Programming Interfaces (APIs), data structures, and the like, that perform particular tasks or implement particular abstract data types. In light of the disclosure provided herein, those of skill in the art will recognize that a computer program may be written in various versions of various languages.

The functionality of the computer readable instructions may be combined or distributed as desired in various environments. In some embodiments, a computer program comprises one sequence of instructions. In some embodiments, a computer program comprises a plurality of sequences of instructions. In some embodiments, a computer program is provided from one location. In other embodiments, a computer program is provided from a plurality of locations. In various embodiments, a computer program includes one or more software modules. In various embodiments, a computer program includes, in part or in whole, one or more web applications, one or more mobile applications, one or more standalone applications, one or more web browser plug-ins, extensions, add-ins, or add-ons, or combinations thereof.

Web Application

In some embodiments, a computer program includes a web application. In light of the disclosure provided herein, those of skill in the art will recognize that a web application, in various embodiments, utilizes one or more software frameworks and one or more database systems. In some embodiments, a web application is created upon a software framework such as Microsoft® .NET or Ruby on Rails (RoR). In some embodiments, a web application utilizes one or more database systems including, by way of non-limiting examples, relational, non-relational, object oriented, associative, and XML database systems. In further embodiments, suitable relational database systems include, by way of non-limiting examples, Microsoft® SQL Server, mySQL™ and Oracle®. Those of skill in the art will also recognize that a web application, in various embodiments, is written in one or more versions of one or more languages. A web application may be written in one or more markup languages, presentation definition languages, client-side scripting languages, server-side coding languages, database query languages, or combinations thereof. In some embodiments, a web application is written to some extent in a markup language such as Hypertext Markup Language (HTML), Extensible Hypertext Markup Language (XHTML), or eXtensible Markup Language (XML). In some embodiments, a web application is written to some extent in a presentation definition language such as Cascading Style Sheets (CSS). In some embodiments, a web application is written to some extent in a client-side scripting language such as Asynchronous Javascript and XML (AJAX), Flash® Actionscript, Javascript, or Silverlight®. In some embodiments, a web application is written to some extent in a server-side coding language such as Active Server Pages (ASP), ColdFusion®, Perl, Java™, JavaServer Pages (JSP), Hypertext Preprocessor (PHP), Python™, Ruby, Tcl, Smalltalk, WebDNA®, or Groovy. In some embodiments, a web application is written to some extent in a database query language such as Structured Query Language (SQL). In some embodiments, a web application integrates enterprise server products such as IBM® Lotus Domino®. In some embodiments, a web application includes a media player element. In various further embodiments, a media player element utilizes one or more of many suitable multimedia technologies including, by way of non-limiting examples, Adobe® Flash HTML 5, Apple® QuickTime®, Microsoft® Silverlight Java™, and Unity®.

Mobile Application

In some embodiments, a computer program includes a mobile application provided to a mobile digital processing device. In some embodiments, the mobile application is provided to a mobile digital processing device at the time it is manufactured. In other embodiments, the mobile application is provided to a mobile digital processing device via the computer network described herein.

In view of the disclosure provided herein, a mobile application is created by techniques known to those of skill in the art using hardware, languages, and development environments known to the art. Those of skill in the art will recognize that mobile applications are written in several languages. Suitable programming languages include, by way of non-limiting examples, C, C++, C#, Objective-C, Java™, Javascript, Pascal, Object Pascal, Python™, Ruby, VB.NET, WML, and XHTML/HTML with or without CSS, or combinations thereof.

Suitable mobile application development environments are available from several sources. Commercially available development environments include, by way of non-limiting examples, AirplaySDK, alcheMo, Appcelerator®, Celsius, Bedrock, Flash Lite, .NET Compact Framework, Rhomobile, and WorkLight Mobile Platform. Other development environments are available without cost including, by way of non-limiting examples, Lazarus, MobiFlex, MoSync, and Phonegap. Also, mobile device manufacturers distribute software developer kits including, by way of non-limiting examples, iPhone and iPad (iOS) SDK, Android™ SDK, BlackBerry® SDK, BREW SDK, Palm® OS SDK, Symbian SDK, webOS SDK, and Windows® Mobile SDK.

Those of skill in the art will recognize that several commercial forums are available for distribution of mobile applications including, by way of non-limiting examples, Apple® App Store, Android™ Market, BlackBerry® App World, App Store for Palm devices, App Catalog for webOS, Windows® Marketplace for Mobile, Ovi Store for Nokia® devices, Samsung® Apps, and Nintendo® DSi Shop.

Standalone Application

In some embodiments, a computer program includes a standalone application, which is a program that is run as an independent computer process, not an add-on to an existing process, e.g., not a plug-in. Those of skill in the art will recognize that standalone applications are often compiled. A compiler is a computer program(s) that transforms source code written in a programming language into binary object code such as assembly language or machine code. Suitable compiled programming languages include, by way of non-limiting examples, C, C++, Objective-C, COBOL, Delphi, Eiffel, Java™, Lisp, Python™, Visual Basic, and VB .NET, or combinations thereof. Compilation is often performed, at least in part, to create an executable program. In some embodiments, a computer program includes one or more executable complied applications.

Software Modules

In some embodiments, the methods, systems, and media disclosed herein include software, server, and/or database modules, or use of the same. In view of the disclosure provided herein, software modules are created by techniques known to those of skill in the art using machines, software, and languages known to the art. The software modules disclosed herein are implemented in a multitude of ways. In various embodiments, a software module comprises a file, a section of code, a programming object, a programming structure, or combinations thereof. In further various embodiments, a software module comprises a plurality of files, a plurality of sections of code, a plurality of programming objects, a plurality of programming structures, or combinations thereof. In various embodiments, the one or more software modules comprise, by way of non-limiting examples, a web application, a mobile application, and a standalone application. In some embodiments, software modules are in one computer program or application. In other embodiments, software modules are in more than one computer program or application. In some embodiments, software modules are hosted on one machine. In other embodiments, software modules are hosted on more than one machine. In further embodiments, software modules are hosted on cloud computing platforms. In some embodiments, software modules are hosted on one or more machines in one location. In other embodiments, software modules are hosted on one or more machines in more than one location.

Databases

In some embodiments, the methods, systems, and media disclosed herein include one or more databases, or use of the same. In view of the disclosure provided herein, those of skill in the art will recognize that many databases are suitable for storage and retrieval of player and game information. In various embodiments, suitable databases include, by way of non-limiting examples, relational databases, non-relational databases, object oriented databases, object databases, entity-relationship model databases, associative databases, and XML databases. In some embodiments, a database is internet-based. In further embodiments, a database is web-based.

In still further embodiments, a database is cloud computing-based. In other embodiments, a database is based on one or more local computer storage devices.

General Information Relating to Various Embodiments of the Invention

A controller, computing device, or computer, such as described herein, may include at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

In some embodiments, a controller may include a processor, which as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system, gaming device, gaming machine or incorporated in an existing gaming system or machine. The gaming machine of the invention may include various computer and network related software and hardware, such as programs, operating systems, memory storage devices, data input/output devices, data processors, servers with links to data communication systems, wireless or otherwise, and data transceiving terminals. It should also be understood that any method steps discussed herein, such as for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

Those skilled in the art will readily appreciate that the apparatus described herein may include various computer and network related software and hardware, such as programs, operating systems, memory storage devices, data input/output devices, data processors, servers with links to data communication systems, wireless or otherwise, and data transceiving terminals. Those skilled in the art will further appreciate that the precise types of software and hardware used are not vital to the full implementation of the apparatus of the invention so long as it performs as described in at least one of the embodiments herein.

Although the present invention and its advantages have been described in detail, it should be understood that various changes, substitutions and alterations can be made herein without departing from the scope of the invention as defined herein. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the invention embraces alternatives, modifications and variations which fall within the spirit and scope of the invention as set forth herein, in the claims and any equivalents thereto.

The invention claimed is:

1. A gaming system, comprising:

at least one processor;

a plurality of input devices, wherein each input device of the plurality of input devices includes a display device;

a data communication device in contact with the plurality of input devices, wherein the plurality of input devices are remotely positioned relative to the data communication device;

a game server, the game server being configured to display a user interface on each input device of the plurality of input devices, whereby a plurality of user interfaces are displayed remotely;

and at least one memory device that stores a plurality of instructions that, when executed by the at least one processor, cause the at least one processor to operate with the game server and communicate with the plurality of input devices to:

a) store data relating to a user account for each user of a plurality of users, wherein the stored data includes a credit balance;

b) receive data relating to a wager created by a first user through the user interface displayed on a first input device, wherein the wager includes a wager data comprising an interactive multiplayer game, a win condition, an amount of credits, and an identification of a user group, the user group including a second user and one or more additional users, wherein the user group has less users than the plurality of users;

c) display a selectable entry in a wager feed through the user interfaces displayed only on each input device of the plurality of input devices for each user in the user group, wherein the selectable entry comprises a viewable display of the wager data on the user interfaces displayed on each input device of the input devices for each user in the user group;

d) responsive to the second user selecting the selectable entry displayed on the user interface displayed on a second input device, the system enabling the second user to enter into the wager with the first user wherein the system deducts or holds credits equal to the amount of credits included in the wager data from the credit balance of the second user, the credit balance of the second user being stored in a second user account;

e) responsive to the second user entering into the wager, display an updated selectable entry in the wager feed through the user interfaces displayed on each input device of the input devices for each user in the user group, wherein the updated selectable entry comprises a viewable display of wager data and a wager status, the wager status relating to the second user entering into the wager with the first user;

f) responsive to one or more additional users selecting the updated selectable entry displayed on the user interface of each input device of the input devices for each user in the user group, the system enabling the one or more additional users to: (i) create a side wager through the user interface, wherein the side wager relates to the win condition of the wager, the side wager being received as side wager data from the user interface comprising an amount of the side wager and a side wager win condition, the system actuating a display of a side wager selectable entry in the wager feed through the user interfaces displayed on each input device of the input devices for each user in the user group, wherein the side wager selectable entry comprises a viewable display of side wager data; and (ii) enter into a created side wager responsive to the one or more additional users selecting at least one of the side wager selectable entry or the updated selectable entry, wherein responsive to selecting the updated selectable entry the system: displays the side wager selectable entry on the user interfaces only for each user in the user group; enables only the one or more additional users to enter into the side wager; and deduct or hold credits equal to the amount of credits included in the side wager data from the credit balance of the one or more additional users entering into the side wager; and g) responsive to the game server operating the interactive multiplayer game, the gaming system determining the outcome of the wager and the outcome of the side wager based on the processor comparing the operation of the interactive multiplayer game with the win condition and the side wager win condition.

2. The system of claim 1, wherein the first user and second user are players in the interactive multiplayer game.

3. The system of claim 1, wherein the game server communicates the operation of the interactive multiplayer game to the user interfaces of the one or more additional users.

4. The system of claim 1, wherein the system enables the one or more additional users to enter side wagers through the user interface during the operation of the interactive multiplayer game.

* * * * *